US005102344A

United States Patent [19]

Tadokoro et al.

[11] Patent Number: 5,102,344

[45] Date of Patent: Apr. 7, 1992

[54] ELECTRICAL CONNECTOR FOR S TERMINAL FOR USE WITH VIDEO EQUIPMENT

[75] Inventors: Shinichi Tadokoro, Fujisawa; Hiroyuki Hagita, Hamamatsu, both of Japan

[73] Assignee: Molex Incorporated, Lisle, Ill.

[21] Appl. No.: 531,986

[22] Filed: Jun. 1, 1990

[30] Foreign Application Priority Data

Jun. 2, 1989 [JP] Japan ..... 1-65328[U]

[51] Int. Cl.[5] ..... H01R 13/652

[52] U.S. Cl. ..... 439/98; 439/610

[58] Field of Search ..... 439/610, 95, 98, 101, 439/108, 677, 799, 103, 92, 96, 97, 607

[56] References Cited

U.S. PATENT DOCUMENTS 2,876,274 3/1959 Cole et al. ..... 439/101
4,291,930 9/1981 Landgreen ..... 439/97
4,790,765 12/1988 Ehrenfels et al. ..... 439/799
4,941,850 7/1990 Ankers et al. ..... 439/610

*Primary Examiner*—Gary F. Paumen
*Assistant Examiner*—Kevin J. Carroll
*Attorney, Agent, or Firm*—Louis A. Hecht; Stephen Z. Weiss; A. A. Tirva

[57] ABSTRACT

An electrical connector for connecting a cable having a pair of coaxial lines each including a core wire and an outer sheath wire to electrical equipment. The connector includes a dielectric holder housing therein a pair of core wire terminals and a pair of sheath wire terminals. A conductive pipe surrounds the holder and an electrical connection is established between the conductive pipe and the sheath wire terminals via a resilient member extending from the sheath wire terminals.

Core wires of the coaxial lines are connected mechanically and electrically to the core wire terminals and the sheath wires of the coaxial lines are connected mechanically and electrically to the conductive pipe which provides an electrical connection path to the sheath wire terminals.

10 Claims, 3 Drawing Sheets

1
2
3
4
5
6
7
8
9
10
11
12
13
14
15
16
17
18
19
20
22
23
24
25
26
27

ELECTRICAL CONNECTOR FOR S TERMINAL FOR USE WITH VIDEO EQUIPMENT

BACKGROUND OF THE INVENTION

1. Field of the Invention

The present invention relates to an electrical connector for 'S'-terminal on a video equipment which is constructed in such a way that a brightness signal and a color signal is separately derived as reproduced outputs in order to realize a higher quality image.

2. Description of the Prior Art

Recently, in order to realize a higher quality image on a display both of the conventional VHS and BETA systems have been substituted by SUPER VHS (abbreviated as 'S-VHS') and ED BETA systems, respectively. As is well known, these new systems have excellent characteristics in that they are capable of preventing the reduction of an FM brightness signal superimposed on a color signal and of slightly widening a bandwidth of the color signal. More specifically, they are capable of separately deriving the brightness signal 'Y' and the color signal 'C' as the reproduced signals.

Thus the video equipment of this kind has a 'Y/C' separate input/output terminal, commonly referred to as an 'S'-terminal, through which the video equipment is connected to a television set and a video camera. For this purpose, an electrical connector for an 'S'-terminal has been developed and widely utilized. More specifically, the prior art connector of this kind is constructed and connected to cables in the manner as described below.

The prior art arrangement of the electrical connector will briefly be described below with reference of FIGS. 6, 7 and 8. A cable 41 comprises a coaxial line 44 consisting of a core wire 42 and an outer sheath wire 43, as well as another coaxial line 47 consisting of a core wire 45 and an outer sheath wire 46. Each of said core wires 42 and 45 of the two coaxial lines 44 and 47 are crimped to each of core terminals 48 and 49, respectively. The core terminals 48 and 49 are mounted in a holder 50 made of electrical insulation material which is then held in a metal pipe 51. The outer sheath wires 43 and 46 are connected in the manner as stated below. The sheath wire 43 of the coaxial line 44 is covered with a heat shrinkable tube 52 as shown in FIG. 7. Heat is applied to the tube 52 shrinking it to form a bundle of the sheath wire 43. In FIG. 8, a bifurcated portion 53 of the coaxial line is also covered with a heat shrinkable tube 54 and heat is applied to shrink the tube 54, thereby protecting the bifurcated portion 53. The equivalent process applies to the sheath wire 46 of the other coaxial line 47. The sheath wires 43 and 46 are crimped to external wiring terminals 55 and 56 which are then mounted in the holder 50.

The prior art arrangement as stated above has a number of deficiencies. First, it takes a longer time to connect the sheath wires 43 and 46 of the coaxial lines 44 and 47 to the external wiring terminals 55 and 56, respectively. Second, due to the use of additional components such as the heat shrinkable tubes and the like, extra amount of materials is required. Third, the metal pipe 51 is not efficiently utilized because it provides only a mechanical positioning capability.

In view of the above, it is an object of the present invention to provide an electrical connector for an 'S'-terminal in which the connection of respective outer sheath wires of two coaxial lines with respective sheath wire terminals can be easily and efficiently be achieved.

It is another object of the present invention to provide an electrical connector for an 'S'-terminal in which a metal pipe can effectively be utilized not only as a mechanical member but also as an electrical member, thereby saving the amount of additional materials which would be required.

In order to achieve the above objects, the present invention provides an electrical connector for an 'S'-terminal, which is used for making connections between video equipment including a video recording/reproducing apparatus and a television set. This connection is made through a cable 1 having a pair of coaxial lines 4 and 7 each made of a core wire and an outer sheath wire. The electrical connector is provided with a pair of core wire terminals 8 and 9 to which core wires 2 and 5 of the coaxial lines 4 and 7 are respectively mechanically and electrically connected and also with a pair of sheath wire terminals 16 and 17 to which the sheath wires 3 and 6 of the coaxial lines 4 and 7 are electrically connected.

An electrically conductive pipe 11 surrounds the outside of holder 10 made of an electrical insulation material. The pipe positions the pair of core wire terminals 8 and 9 and the pair of sheath wire terminals 16 and 17, and has the sheath wires 3 and 6 of the pair of coaxial lines 4 and 7 jointly connected to the rear end 14 of the conductive pipe 11. The sheath wires 3 and 6 of the pair of coaxial lines 4 and 7 are also, respectively, connected to the pair of sheath wire terminals 16 and 17 via the conductive pipe 11 by the electrical connection of the pair of sheath wire terminals 16 and 17 to the conductive pipe 11.

According to the arrangement as stated above, electrical connection of the cable 1 and the electrical connector is effected as follows. The core wires 2 and 5 of the coaxial lines 4 and 7 are connected to the core wire terminals 8 and 9 in the conventional manner. The sheath wires 3 and 6 of the coaxial lines 4 and 7 are formed into a bundle which is connected to the rear end 14 of the conductive pipe 11. In one embodiment, the bundle of the sheath wires is crimped to the rear end by a crimp terminal 15 mounted thereon. In such a connection, there is no need for the heat shrinkable tube and the like as in the prior art arrangement. At this time, the sheath wire terminals 16 and 17 mounted inthe holder 10 have been electrically connected to the front portion of the conductive pipe 11. More specifically, a resilient member 19 extending from a coupler member 18 of the sheath wire terminals 16 and 17 is in resilient contact with the inner peripheral surface of the conductive pipe 11. Thus, the sheath wires 3 and 6 of the coaxial lines 4 and 7 are electrically connected to the sheath wire terminals 16 and 17 via the conductive pipe 11. According to this arrangement, there is no need for the crimp terminal to be used for connection of sheath wire terminals 16 and 17 to the sheath wires 3 and 6. In addition to positioning the holder 10, the conductive pipe 11 also serves as the electrical connection member.

BRIEF DESCRIPTION OF THE DRAWINGS

The present invention will now be described with reference to a preferred embodiment of an electrical connector for an 'S'-terminal shown in the accompanying drawings.

FIG. 1 is an exploded perspective view of the electrical connector according to the present invention. FIG. 2 is a perspective view of a holder before a sheath wire terminal is assembled thereto.

FIG. 3 shows the components of the electrical connector in a partial longitudinal cross-sectional view taken along the center line thereof.

FIG. 4 is a cross-sectional view of the crimp terminal taken along a line 4—4 in FIG. 3.

FIG. 5 is a cross-sectional view of a cable to be connected to the electrical connector for an 'S'-terminal taken along a line 5—5 in FIG. 3.

FIG. 6 is an exploded perspective view of the prior art electrical connector.

FIG. 7 shows a coaxial line having sheath wires covered with a heat tube.

FIG. 8 is a perspective view of the coaxial line having a bifurcated portion covered with a heat shrinkable tube.

DESCRIPTION OF THE PREFERRED EMBODIMENT

Figures 1, 2:
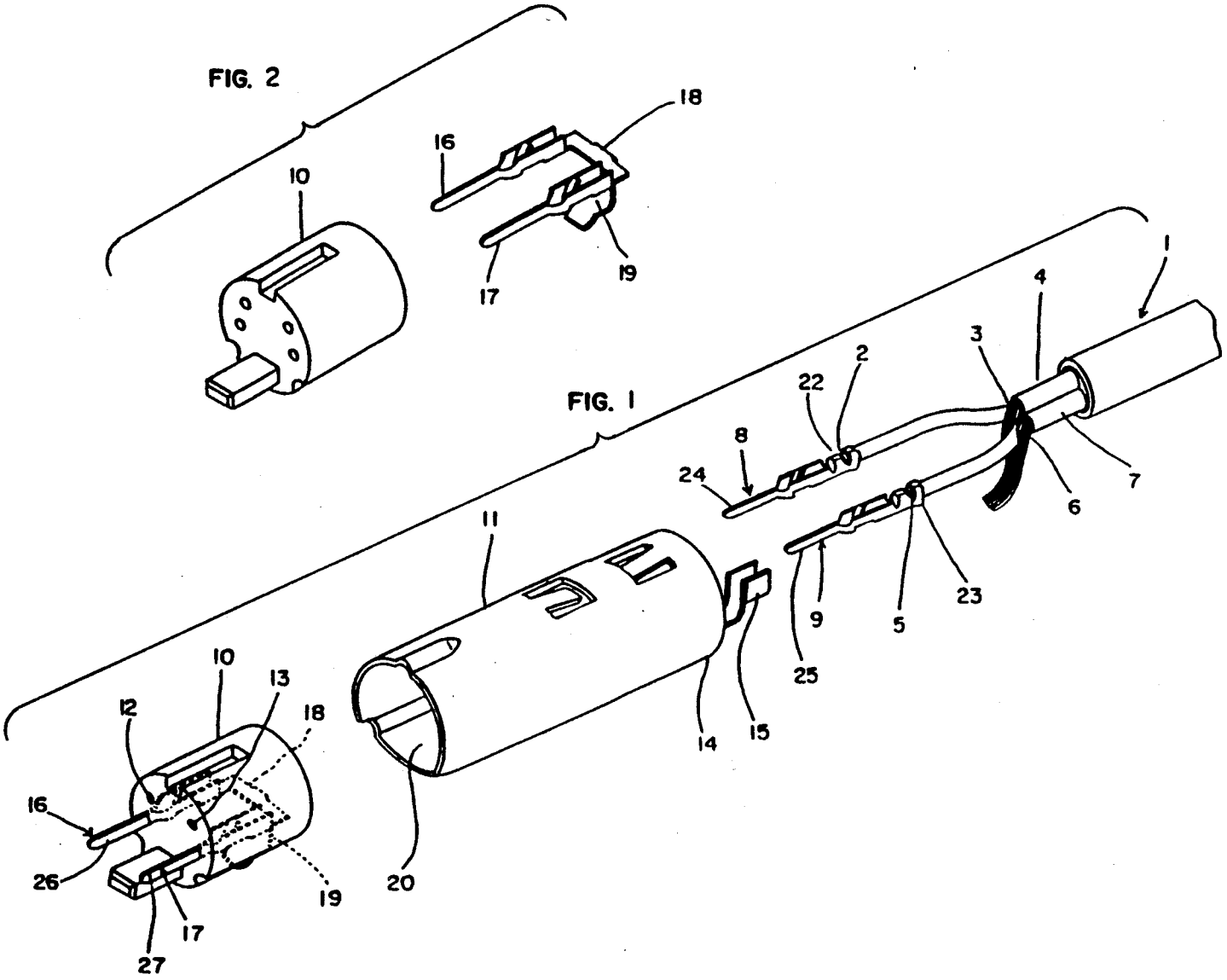
FIGS. 1 through 5 show a preferred embodiment of an electrical connector for an 'S'-terminal constructed according to the present ivention.
Figure 3:
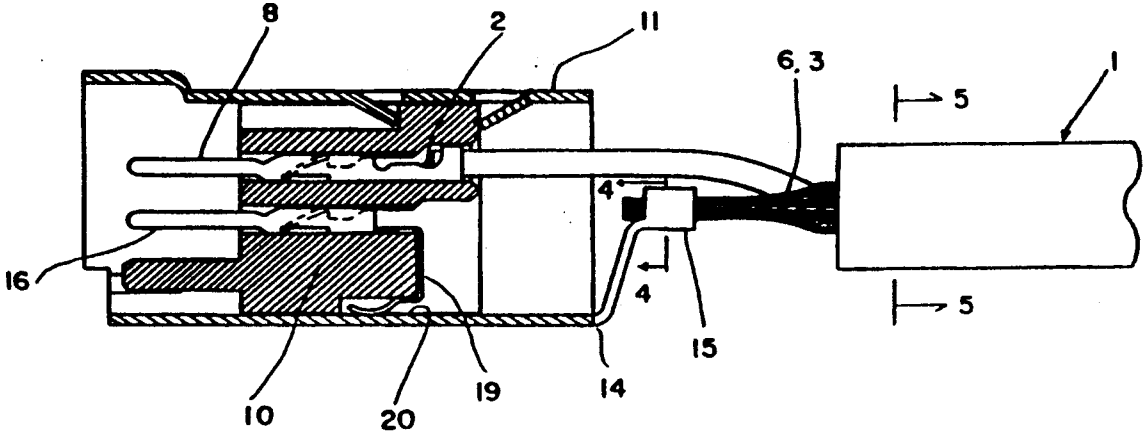
Figure 5:
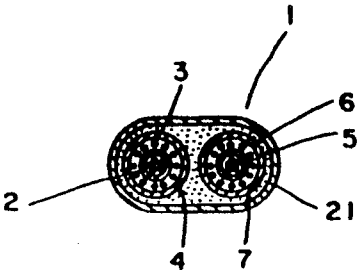
Figure 4:
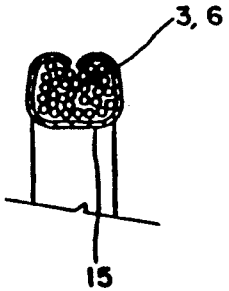
Figures 6, 7, 8:
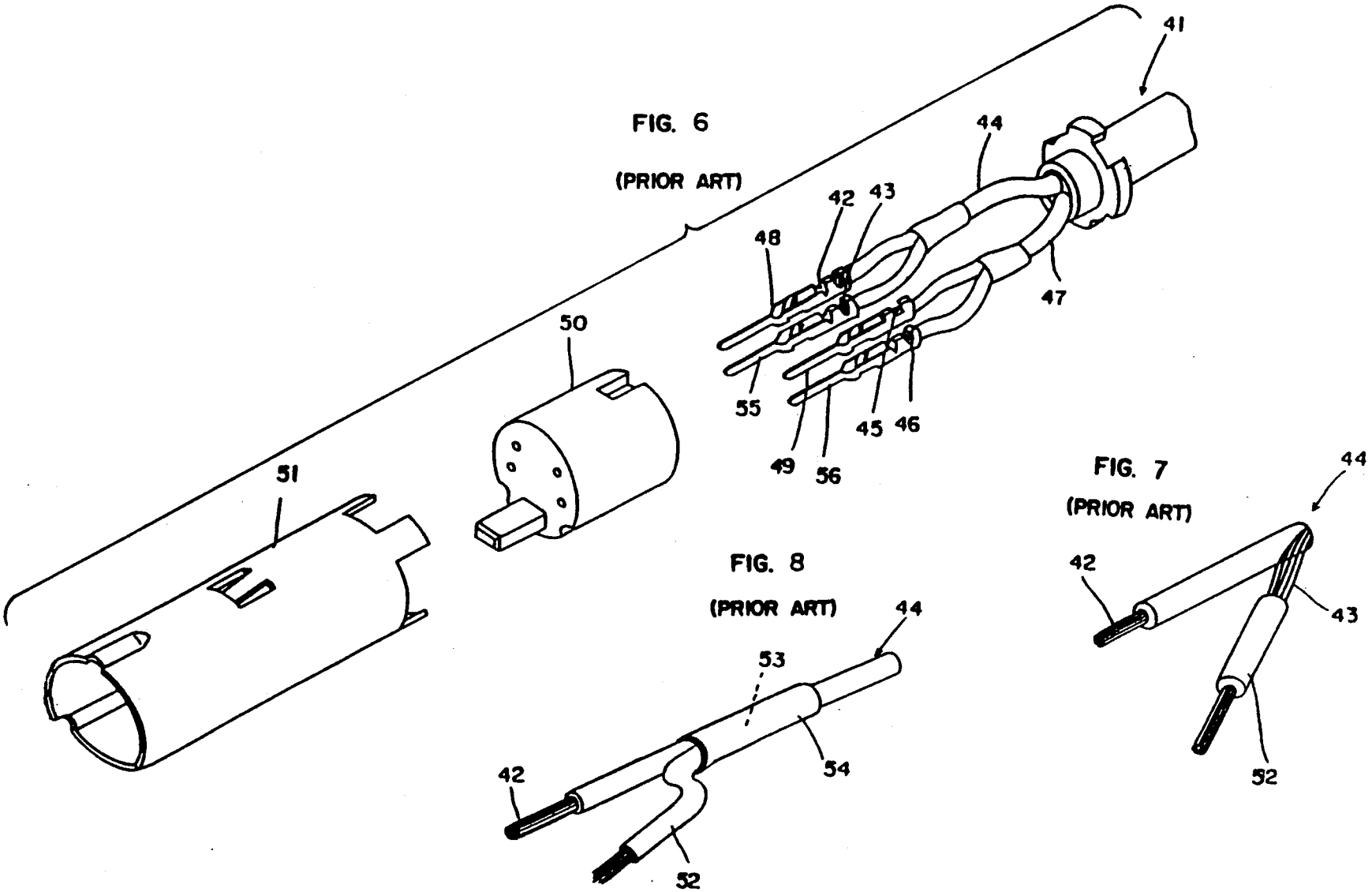
FIG. 6 (PRIOR ART)
FIG. 7 (PRIOR ART)
FIG. 8 (PRIOR ART)
FIGS. 6 through 8 show an arrangement of a prior art electrical connector for an 'S'-terminal.

The present invention will now be described with reference to FIGS. 1 and 5.

A cable 1 used with a SUPER VHS or ED BETA video equipment will briefly be described by way of example. The cable 1 has two coaxial lines 4 and 7 arranged in parallel and covered with an insulator 21. The coaxial lines 4 and 7 have core wires 2 and 5 and outer sheath wires 3 and 6, respectively. The cable 1 is adapted for use with an electrical connector for an 'S'-terminal.

The electrical connector has core wire terminals 8 and 9. The core wire terminals 8 and 9 have respective crimping portions 22 and 23 at the rear ends thereof. The core wire terminals 8 and 9 are inserted into holes 12 and 13 in a holder 10 made of electrically insulating material with forward end contact portions 24 and 25 forwardly extended. The sheath wire terminals 16 and 17 are coupled together at the rear end thereof by a coupler member 18. The coupler member 18 has a resilient member 19 integrally mounted on the lower portion thereof. The sheath wire terminals 16 and 17, shown as an integral member, are mounted in the holder 10 with forward end contact portions 26 and 27 forwardly extended. The holder 10 is covered with and held by an electrically conductive pipe 11. The resilient member 19 of the sheath wire terminals 16 and 17 resiliently contacts an inner peripheral surface 20 of the conductive pipe 11. The electrically conductive pipe 11 has inwardly directed projections 28, 29 which secure the conductive pipe to the holder 10. One projection 28 extends into a recess 30 in the outer surface of the holder 10 and the other projection 29 engages the rear face of the holder 10. The conductive pipe 11 has a 'U'-shaped crimping member 15 mounted on the rear end 14.

According to the arrangement as described above, the electrical connection of the cable 1 and the electrical connector is effected as follows.

At first the core wires 2 and 5 of the coaxial lines 4 and 7 are connected to the core wire terminals 8 and 9, respectively, by the crimping portions 22 and 23. Then, the core wire terminals 8 and 9 are inserted through openings in the holder 10 and held therein. The outer sheath wires 3 and 6 of the coaxial lines 4 and 7 are formed into a bundle which is then crimped to the conductive pipe 11 by the crimping member 15. The recess 30 of the holder 10 is aligned with the projections 28,29 of the conductive pipe 11, and then the holder 10 is inserted into the pipe 11. Thereafter, the resilient member 19 of the sheath wire terminals 16 and 17 contacts the inner peripheral surface 20 of the conductive pipe 11 so that the sheath wires 3 and 6 are electrically connected to the sheath wire terminals 16 and 17 via the conductive pipe 11.

Although in the prior art arrangement, the pipe 11 was used only for mechanically positioning the holder 10, the present invention provides a more efficient use of the pipe 11 as it is made of electrically conductive material which enables the highly efficient connection of the cable 1.

Specifically, only one crimping operation is required for crimping the sheath wires 3 and 6 to the rear end of the conductive pipe 11 and any other operation such as those for forming a bundle by use of the heat shrinkable tube are no longer necessary. The sheath wire terminals 16 and 17 are electrically connected to the conductive pipe 11 via the resilient member 19 so that there is no need for crimping the sheath wires 3 and 6 to the sheath wire terminals 16 and 17, respectively.

It is to be noted that although an outermost resin mold has not been shown and described in the embodiment as stated above, it may be provided in the usual manner. Additionally, although the sheath wires 3 and 6 have been crimped to the rear end 14 of the conductive pipe 11 by the crimping member 15, a connection method other than crimping may also be used. Furthermore, although in the embodiment as stated above, the sheath wire terminals 16 and 17 have been coupled together by use of the coupler member 18 and the resilient member 19 common to both terminals 16 and 17 has been used for connection with the inner surface 20 of the conductive pipe 11, the sheath wire terminals 16 and 17 may each be provided with a resilient member.

It is apparent from the foregoing that according to the first aspect of the present invention, the cable can be easily, simply and efficiently connected to the electrical connector for an 'S'-terminal. More specifically, the conductive pipe can serve not only for mechanical positioning, but also for an electrical connector so that the number of steps for connecting coaxial lines such as crimping and the like can be reduced. Also, there is no further need for using additional materials such as a heat shrinkable tube and the like.

According to the second aspect of the present invention, higher reliability and ease in connecting the sheath wires of the coaxial lines to the conductive pipe can be achieved because of the connection method in which the sheath wires are jointly coupled to each other and crimped to the rear end of the conductive pipe.

According to the third aspect of the present invention, a compact electrical contact arrangement for sheath wire terminals relative to the conductive pipe can be achieved because of the connection of two sheath wire terminals and the use of a common resileint member for connecting them to the conductive pipe.

What is claimed is:

1. A shielded electrical connector for electrically connecting a cable to an electronic apparatus, said cable composed of a pair of coaxial lines each made of a core wire and an outer sheath wire, wherein said electrical connector is provided with a pair of core wire terminals each having two sections, a first section mating with a corresponding contact terminal of a receptacle and a second section to which a said core wire of said coaxial lines is respectively connected, and said electrical connector is also provided with a pair of sheath wire terminals each having two sections, a first section mating with a corresponding contact terminal of a receptacle and a second section to which a said sheath wire of said coaxial lines is electrically connected, characterized in that:

an electrically conductive pipe is installed on the outside of a holder, which holder is composed of an electrical insulator for positioning and securing therein said pair of core wire terminals and said pair of sheath wire terminals, wherein said sheath wires of said pair of coaxial lines are jointly connected and crimped to the rear end of said conductive pipe by a crimping member, and wherein said sheath wires of said pair of coaxial lines are respectively electrically connected to said pair of sheath wire terminals by way of said conductive pipe with a disengageable electrical connection of said pair of sheath wire terminals to said conductive pipe.

2. An electrical connector as claimed in claim 1 wherein said pair of sheath wire terminals have resilient members extending in a direction opposite said first mating section, resiliently contacting the inner surface of said conductive pipe so that an electrical connection between said conductive pipe and said pair of sheath wire terminals is established.

3. An electrical connector as claimed in claim 2 wherein said crimping member is mounted on said pipe.

4. An electrical connector as claimed in claim 2 wherein said crimping member is formed integrally with said pipe.

5. An electrical connector as claimed in claim 4 wherein said electrically conductive pipe has a continuous inner diameter.

6. An electrical connector as claimed in claim 5 wherein inwardly directed projections are formed in said electrically conductive pipe.

7. An electrical connector as claimed in claim 6 wherein said holder has a recess in its outer surface into which one of said inwardly directed projections of said pipe extends.

8. A method of applying an electrical connector to a cable having a pair of coaxial lines, each line having a core wire and a sheath wire, to terminate the cable with a shielded connector, comprising the steps of:

inserting, into a front portion of an electrically conductive pipe, an electrically insulated holder having axially extending terminal receiving passageways therethrough, said holder having inserted sheath wire terminals in some of said passageways which resiliently contact the inner surface of said pipe so that an electrical connection between said pipe and said pair of sheath wire terminals is established;

forming inwardly directed projections on said pipe to secure said holder therein;

inserting through a rear section of said pipe and into remaining said passageways electrical terminals terminated to respective core wires of said cable and securing said terminals in said passageways; and crimping said pair of sheath wires to an end of said pipe.

9. A method as defined in claim 8 further comprising the step of aligning a recess in the outer surface of said holder with said inwardly directed projections formed in said pipe prior to said step of inserting said holder into said pipe.

10. A method as defined in claim 9 wherein said step of inserting said holder into said pipe includes the step of stopping insertion after said holder contacts one of said inwardly directed projections.

* * * * *